US005799334A

United States Patent [19]

Griffith et al.

[11] Patent Number: 5,799,334

[45] Date of Patent: Sep. 1, 1998

[54] BASEBALL CAP FOR PIGTAIL HAIRSTYLES

[76] Inventors: Dianne E. Griffith, 7710 Westlake Dr., West Palm Beach, Fla. 33406; Glenn C. Griffith, 4945 Castayls Dr., Pensacola, Fla. 32504

[21] Appl. No.: 839,871

[22] Filed: Apr. 17, 1997

[51] Int. Cl.[6] ..... A42B 1/00

[52] U.S. Cl. ..... 2/195.1; 2/171

[58] Field of Search ..... 2/195.1, 171.1, 2/182.8, 174, 209.13, 209.7, 171.4, 181.4, 184.5, 171, 171.5, 171.6, 171.7, 171.8, 181, 181.2, 209.11, 209.12, 209.3, 181.5

[56] References Cited

U.S. PATENT DOCUMENTS

| | | | |
|---|---|---|---|
| D. 173,620 | 12/1954 | Kreiger et al. | 2/171 X |
| 1,614,231 | 1/1927 | Cosgrove | 2/195 |
| 1,704,576 | 3/1929 | Pellegrino | 2/209.7 |
| 1,996,254 | 4/1935 | Parlow | 2/209.7 |
| 2,864,383 | 12/1958 | Jacks et al. | 2/195 |
| 4,131,953 | 1/1979 | Kimotsuki | 2/171.1 |
| 4,872,218 | 10/1989 | Holt | 2/171.5 |
| 4,991,237 | 2/1991 | Dwyer | 2/209.7 |
| 4,998,544 | 3/1991 | Obergfell | 2/209.3 |
| 5,170,509 | 12/1992 | Leopold | 2/199 |
| 5,239,705 | 8/1993 | Leopold | 2/209.13 |
| 5,321,854 | 6/1994 | Kronenberger . | |
| 5,509,145 | 4/1996 | Stevenson . | |

*Primary Examiner*—Gloria M. Hale
*Attorney, Agent, or Firm*—McHale & Slavin

[57] ABSTRACT

A baseball cap to accommodate pigtail and non-bundled hairstyles comprises a head covering portion formed from a front panel spaced-apart from a back panel by a plurality of side panels. Each side panel includes an opening bound by elastic. The openings are formed by overlapping tabs and selectively covered by a flap. Each opening is sized to accept a bundle of hair passed therethrough. A light deflecting brim extends outward from the front panel.

8 Claims, 2 Drawing Sheets

BASEBALL CAP FOR PIGTAIL HAIRSTYLES

FIELD OF THE INVENTION

The present invention relates specifically to a baseball cap having selectively-covered openings to accommodate pigtail hairstyles.

BACKGROUND OF THE INVENTION

The baseball cap has long been a utility garment as well as a fashion accessory. As a utility garment, the cap is worn with a large brim to shade the individual's eyes from the sun. As a fashion accessory, the cap may show support for a favorite sporting team or other group.

Many people wear this casual hat with casual hairstyles. Two such hairstyles are ponytails and pigtails. A ponytail hairstyle refers to a hairstyle in which an individual's hair is gathered, at the top or back of an individual's head, into a single accumulation. Alternatively, a pigtail hairstyle is created when an individual's hair is bundled into two separate collections, with each collection extending radially from the side of the individual's head.

Manufacturers have attempted to design baseball caps suited specifically for use with ponytails. For example, U.S. Pat. No. 5,321,854 discloses a baseball cap with an opening for a ponytail found at the back of the cap. U.S. Pat. No. 5,511,249 discloses a baseball cap with an opening to accept a bundle of hair extending from the top of an individual's head. This design is not well-suited for use when an individual's hair is not bundled into a ponytail. This design further left gaping holes which plagued the cap's appearance, until camouflaged by bundles of hair. Although this design provides an alternative to the limitations of earlier caps, it is unsightly when worn without a bundle of hair extending through the opening.

U.S. Pat. No. 5,509,145 attempts to improve the appearance of ponytail-accommodating caps which are worn without ponytails. The cap employs a rigid two-part plug inserted into an opening in the top of the cap. By removing the plug, an individual reveals an opening through which a bundle of hair may be passed. Because this design relies on an opening that cooperates with an insertable plug, placement of the opening is critical. With the opening located at the very top of the hat, where there is sufficient clearance between an individual's head and the material of the hat, a plug may be inserted with no loss in comfort. Yet, another problem created by using this design with pigtail hairstyles is that it incorporates relatively small, removable pieces. Some pigtails are commonly worn by young children, removable plugs for young children pose a serious choking hazard and would make the hat unsuitable for a large portion of its target audience.

Accordingly, what is needed in this field is a baseball cap that is comfortable to wear and fashionable in appearance when worn with either non-bundled or pigtail hair styles.

SUMMARY OF THE INVENTION

The present invention is a baseball cap designed for comfortable use by individuals with short hair and long hair, alike. The device employs a head covering portion shaped to fit the top portion of an individual's head. The head covering portion includes a substantially-continuous sidewall bound on the bottom by a rim portion. The sidewall is further defined by a front panel that is spaced apart from a back panel by a multitude of side panels.

The cap employs a pair of openings through which two bundles of hair extending from an individual's head, commonly-known as "pigtails," may be passed. These openings are located in two of the side panels, on opposite sides of the head covering portion. In one embodiment of the invention, the openings are bound by elastic. In a second embodiment, the openings are selectively covered by flaps attached to the side panels. The openings may be cut into side panels of the cap portion or they may be formed by pairs of tabs removably secured in an overlapped orientation. The cap may be worn fashionably both by individuals who have a "pigtail" hairstyle and those who do not.

Accordingly, it is an object of the present invention to provide a baseball cap that accommodates a pigtail hairstyle, the cap being equally suitable for use with non-bundled hairstyles.

It is still another object of the present invention to provide a baseball cap that accommodates a pigtail hairstyle, the cap containing no removable pieces which could be lost or present choking hazards.

Still another object of the present invention is to disclose a cap having sidewall adjustments allowing for the placement of pigtails through the openings and allow for the simultaneous adjustment of the cap to the individual's head.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
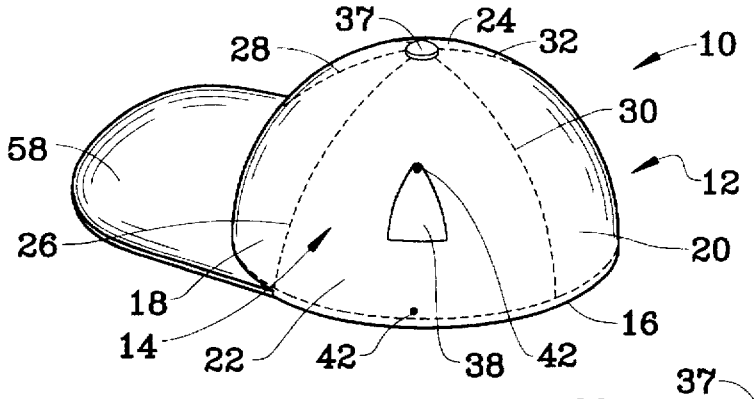
FIG. 1 is a perspective view of the baseball cap of the present invention.
Figure 2:
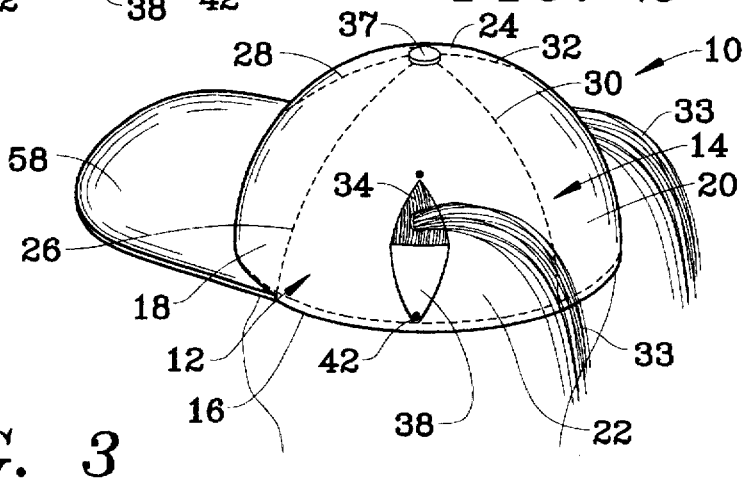
FIG. 2 is a perspective view of the baseball cap of the present invention with its openings uncovered and bundles of hair passing therethrough.
Figure 3:
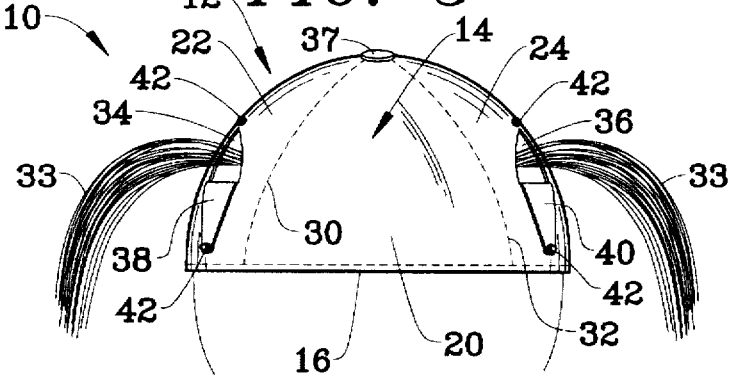
FIG. 3 is a rear view of the baseball cap of the present invention with its openings uncovered and bundles of hair passing therethrough.

Reference is now made to FIGS. 1, 2 and 3, wherein a baseball cap 10 having dual openings to accommodate "pigtail" hair styles is shown. The cap 10 includes a head covering portion 12 having a sidewall 14 sized and shaped to accommodate an individual's head. The bottom edge of the sidewall 14 is bounded by a rim portion 16. The sidewall 14 is a substantially-hemispherical shell defined by a front panel 18, that is spaced-apart from a back panel 20 by a plurality of side panels 22,24. In one embodiment, the cap 10 has four panels. The front panel 18 is sewn to a first side panel 22 and a second side panel 24 at a first front seam 26 and second front seam 28, respectively. The back panel 20 is similarly sewn to the first side panel 22 and the second side panel 24 at a first rear seam 30 and a second rear seam 32, respectively.

Heat welding, adhesive, or other suitable attachment methods may also be used to join the panels 18, 20, 22, 24 at their respective seams 26, 28, 30, 32. Additionally, the sidewall 14 may be formed from any number of panels without detriment. This cap 10 is designed to accommodate a hairstyle commonly known as a "pigtail" hairstyle. This is a casual hairstyle characterized by bundles of hair 33 which extend radially from an individual's head. The cap 10 of the present invention includes features which make it appropriate specifically for this hairstyle. These features also make this cap 10 appropriate for individuals who do not have a pigtail hairstyle.

A major feature of this cap 10 which makes it well-suited for use with pigtail hairstyles is the inclusion of two openings 34, 36, one each on opposite sides 22, 24 of the cap 10. These openings 34, 36 are vertically located approximately half-way between the bottom rim 16 and the apex 37 of the cap 10. More specifically, and with reference to FIGS. 2 and 3, the first side panel 22 includes a first opening 34. The second side panel 24 includes a second opening 36. The openings 34, 36 are sized to accept a bundle of hair 33 that has been collected on the side of an individual's head into a pigtail and passed through one of the openings 34, 36. As shown in FIGS. 1, 2, 3 and 4, each opening 34, 36 is covered by a flap 38, 40. These flaps 38, 40 advantageously allow an individual to selectively conceal or reveal an opening 34, 36. Accordingly, the flaps 38, 40 allow the cap 10 to be worn both by individuals with pigtail hairstyles and individuals without pigtail hairstyles. Snaps 42 or other fastening means are included on the side panels 22, 24 and flaps 38, 40 to selectively secure the flaps 38, 40 so they reveal or conceal the openings 34, 36, according to the hat-wearer's hairstyle and fashion preference.

Figure 4:
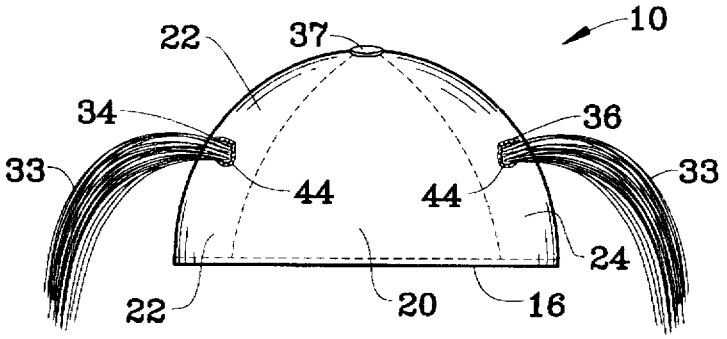
FIG. 4 is a rear view of the baseball cap of the present invention showing elastic around its openings and bundles of hair passing therethrough.

As shown in FIG. 4, the openings 34, 36 are trimmed with elastic 44. This elastic 44 advantageously imparts an adjustable diameter to each opening 34, 36, resulting in a cap 10 which accepts pigtails 33 of various size. The elastic 44 is sewn onto cap 10, but other methods of attachment may be used.

Figure 5:
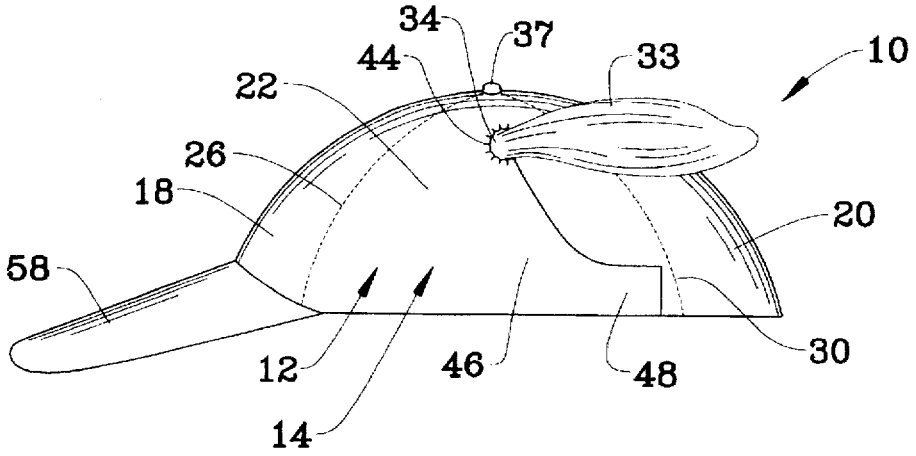
FIG. 5 is a side view of a baseball cap according to the present invention showing its openings formed by overlapping tabs.
Figure 6:
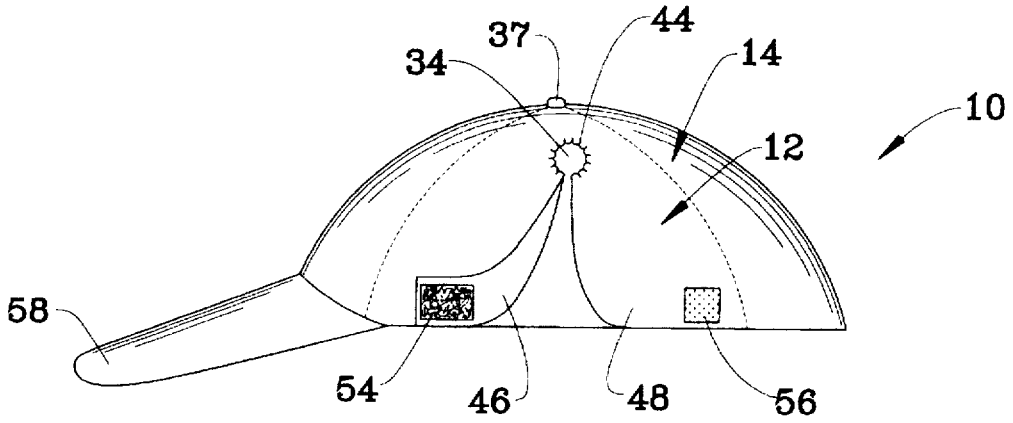
FIG. 6 is a side view of a baseball cap according to the present invention showing its overlapping in a separated orientation.
Figure 7:
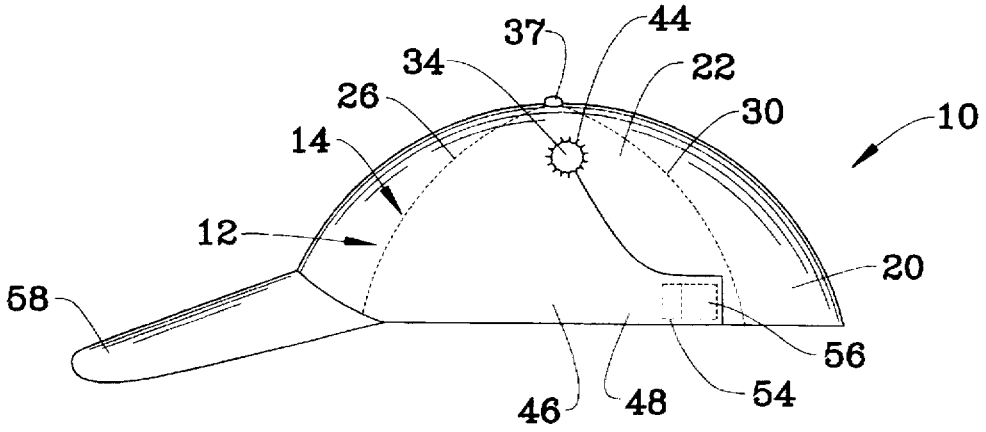
FIG. 7 is a side view of a baseball cap according to the present invention showing the overlapping tabs in an overlapped orientation.

In an alternate embodiment, as shown in FIGS. 5, 6, and 7, the first opening 34 and second opening 36 are bounded by a first pair of overlapping tabs 46, 48 and a second pair of overlapping tabs 50, 52, respectively. First front tab 46 and first rear tab 48 are formed integral with the first side panel 22. The first, front and rear tabs 46, 48 include cooperating hook and loop fasteners 54, 56 (see FIG. 6). The fasteners 54, 56 are positioned to allow the front and rear tabs 46, 48 to be releasably secured in an overlapped orientation, as shown in FIG. 7, with the front tab 46 pulled away from the rear tab 48. A bundle of hair collected into a pigtail 33 may be passed laterally, upward into the opening 34. Once the pigtail 33 is in place, the tabs 46, 48 may be overlapped and secured by the hook and loop fasteners 54, 56. The use of hook and loop fasteners 54, 56 provides enhanced control over the size of the opening 34. However, other types of fasteners, including snaps or buttons, may be used, instead.

Similarly, the second front tab 50 and second rear tab 52 are formed integral with the second side panel 24. The second set of tabs 50, 52 forms substantially a mirror image of the first set of front and rear tabs 46, 48, described above. The second set of tabs 50, 52 includes hook and loop fasteners 54, 56 and functions in substantially the same manner as the first set of tabs 46, 48, described above.

The cap 10 also includes a brim attached at the bottom or rim portion 16 of the front panel 18. This brim 18 advantageously shades an individual's eyes from overhead light. This brim 58 may be deleted without negatively impacting the cap's suitability for use with pigtail and non-pigtail hairstyles.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A baseball cap to accommodate hair worn in a pigtail style, said cap comprising:

a head covering portion having a substantially continuous sidewall sized and shaped to accommodate the upper portion of an individual's head, a lower edge of said sidewall being bounded by a rim portion, said sidewall further defined by a front panel spaced apart from a back panel by a plurality of side panels, each of said panels being substantially-triangular;

a first opening disposed in a first side panel;

a second opening disposed in a second side panel, each of said openings sized to accept a bundle of hair for placement therethrough;

a first flap sized and positioned to selectively cover said first opening;

a second flap sized and positioned to selectively cover said second opening; and a brim portion extending orthogonally from said front panel.

2. The head-covering device of claim 1, wherein:

said first opening is formed by a front tab portion of said first side panel that cooperates with a corresponding rear tab portion of said first side panel, said front and rear tab portions including securing means to releasably mate said corresponding tab portions in an overlapped orientation; and said second opening is formed by a front tab portion of said second side panel that cooperates with a corresponding rear tab portion of said second side panel, said front and rear tab portions including securing means to releasably mate said corresponding tab portions in an overlapped orientation.

3. A baseball cap to accommodate hair worn in a pigtail style, said cap comprising:

a head covering portion having a substantially continuous sidewall sized and shaped to accommodate the upper portion of an individual's head, a lower edge of said sidewall being bounded by a rim portion, said sidewall further defined by a front panel spaced apart from a back panel by a plurality of side panels, each of said panels being substantially-triangular a first opening disposed in a first side panel;

a second opening disposed in a second side panel, each of said openings being bounded by an elastic gather and sized to accept a bundle of hair for placement therethrough;

a first flap sized and positioned to selectively cover said first opening;

a second flap sized and positioned to selectively cover said second opening; and a brim portion extending orthogonally from said front panel.

4. The baseball cap of claim 3, wherein:

said first opening is formed by a front tab portion of said first side panel that cooperates with a corresponding rear tab portion of said first side panel, said front and rear tab portions including securing means to releasably mate said corresponding tab portions in an overlapped orientation; and said second opening is formed by a front tab portion of said second side panel that cooperates with a corresponding rear tab portion of said second side panel, said front and rear tab portions including securing means to releasably mate said corresponding tab portions in an overlapped orientation.

5. A baseball cap to accommodate hair worn in a pigtail style, said cap comprising:

a head covering portion having a substantially continuous sidewall sized and shaped to accommodate the upper portion of an individual's head, a lower edge of said sidewall being bounded by a rim portion, said sidewall further defined by a front panel spaced apart from a back panel by a plurality of side panels, each of said panels being substantially-triangular;

a first opening disposed in a first side panel;

a second opening disposed in a second side panel, each of said openings sized to accept a bundle of hair for placement therethrough;

a first flap sized and positioned to selectively cover said first opening;

a second flap sized and positioned to selectively cover said second opening; and a brim portion extending orthogonally from said front panel, whereby the distance between said first and second openings is bisected by a straight line drawn from the center of said front panel to the center of said back panel.

6. The baseball cap of claim 5, wherein each of said openings is bounded by an elastic gather.

7. The baseball cap of claim 5, wherein:

said first opening is formed by a front tab portion of said first side panel that cooperates with a corresponding rear tab portion of said first side panel, said front and rear tab portions including securing means to releasably mate said corresponding tab portions in an overlapped orientation; and said second opening is formed by a front tab portion of said second side panel that cooperates with a corresponding rear tab portion of said second side panel, said front and rear tab portions including securing means to releasably mate said corresponding tab portions in an overlapped orientation.

8. The baseball cap of claim 7, wherein each of said openings is bounded by an elastic gather.

* * * * *